US009861136B2

(12) United States Patent
Li et al.

(10) Patent No.: US 9,861,136 B2
(45) Date of Patent: Jan. 9, 2018

(54) LIQUID SUPPLY, ATOMIZER AND ELECTRONIC CIGARETTE HAVING SAME

(71) Applicant: Shenzhen First Union Technology Co., Ltd., Shenzhen, Guangdong Province (CN)

(72) Inventors: Yonghai Li, Shenzhen (CN); Zhongli Xu, Shenzhen (CN); Hongxing Duan, Shenzhen (CN); Yansheng Zhang, Shenzhen (CN)

(73) Assignee: SHENZHEN FIRST UNION TECHNOLOGY CO., LTD., Shenzhen, Guangdong Province (CN)

( * ) Notice: Subject to any disclaimer, the term of this patent is extended or adjusted under 35 U.S.C. 154(b) by 339 days.

(21) Appl. No.: 14/735,074

(22) Filed: Jun. 9, 2015

(65) Prior Publication Data

US 2016/0219934 A1 Aug. 4, 2016

(30) Foreign Application Priority Data

Feb. 4, 2015 (CN) ..... 2015 1 0057585

(51) Int. Cl.
*A24F 17/00* (2006.01)
*A24F 47/00* (2006.01)
*B65D 85/00* (2006.01)

(52) U.S. Cl.
CPC ..... *A24F 47/008* (2013.01); *B65D 85/70* (2013.01)

(58) Field of Classification Search
CPC ..... A24F 47/008; A24F 47/002; A24F 47/00; B65D 85/70; H05B 3/0014; H05B 3/14
USPC ..... 131/329
See application file for complete search history.

(56) References Cited

U.S. PATENT DOCUMENTS

2015/0342255 A1* 12/2015 Wu ..... A61M 15/06 131/329
2015/0342257 A1* 12/2015 Chen ..... H05B 3/06 392/390
2016/0135504 A1* 5/2016 Li ..... A24F 47/008 392/395
2016/0219934 A1* 8/2016 Li ..... B65D 85/70
2016/0219935 A1* 8/2016 Qiu ..... A24F 47/008
2016/0227841 A1* 8/2016 Li ..... A61M 15/06
2016/0249683 A1* 9/2016 Li ..... A24F 47/008 131/329

(Continued)

*Primary Examiner* — Khiem Nguyen
(74) *Attorney, Agent, or Firm* — Cheng-Ju Chiang

(57) ABSTRACT

An exemplary atomizer includes a liquid supply and an atomizing assembly. The liquid supply is configured for storing tobacco liquid, and has an open end. The atomizing assembly is detachably connected to the open end. The atomizing assembly includes an atomizing cavity and an atomizing unit. The atomizing unit is configured for heating the tobacco liquid to form aerosol. The atomizing assembly includes a connector configured for connecting with the liquid supply. The connector defines a liquid inlet. The open end is provided with a sealing component having a liquid outlet. The connector is engaged in the open end. The liquid supply further includes a rotation component abutting against the sealing component. The connector is capable of driving the rotation component to rotate between a first position where the rotation component blocks the liquid outlet, and a second position where the liquid outlet communicates with the liquid inlet.

16 Claims, 9 Drawing Sheets

(56) References Cited

U.S. PATENT DOCUMENTS

2017/0181476 A1* 6/2017 Li ..... A24F 47/008
2017/0202268 A1* 7/2017 Li ..... A24F 47/008

* cited by examiner

LIQUID SUPPLY, ATOMIZER AND ELECTRONIC CIGARETTE HAVING SAME

TECHNICAL FIELD

The present invention relates to electronic cigarettes, and particularly to a liquid supply, an atomizer and an electronic cigarette using same.

BACKGROUND ART

A typical atomizer includes a liquid supply and an atomizing assembly. The liquid supply is configured for storing tobacco liquid, and the tobacco liquid is usually sealed by aluminum foil. The atomizing assembly includes a pricking component. When the liquid supply is coupled to the atomizing assembly, the pricking component pierces the aluminum foil, so that the tobacco liquid flows into the atomizing assembly. However, when replacing the liquid supply with a new one, the tobacco liquid remained in the liquid supply may flow out and pollute the atomizing assembly. Accordingly, user experience of the atomizer is unsatisfactory.

What is needed, therefore, are a liquid supply, an atomizer and an electronic cigarette using same, which can overcome the above shortcomings.

SUMMARY

An exemplary atomizer includes a liquid supply and an atomizing assembly. The liquid supply is configured for storing tobacco liquid. The liquid supply has an open end. The atomizing assembly is detachably connected to the open end. The atomizing assembly includes an atomizing cavity and an atomizing unit. The atomizing unit is configured for heating the tobacco liquid to form aerosol. The atomizing assembly includes a connector configured for connecting with the liquid supply. The connector defines a liquid inlet. The open end is provided with a sealing component having a liquid outlet. The connector is engaged in the open end to form a snap-fit connection after the connector is rotated a predetermined angle. The liquid supply further includes a rotation component abutting against the sealing component. The connector is capable of driving the rotation component to rotate between a first position where the rotation component blocks the liquid outlet, and a second position where the liquid outlet communicates with the liquid inlet. When the connector is engaged in the open end, the rotation component is in the second position.

BRIEF DESCRIPTION OF THE DRAWINGS

Many aspects of the present disclosure can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
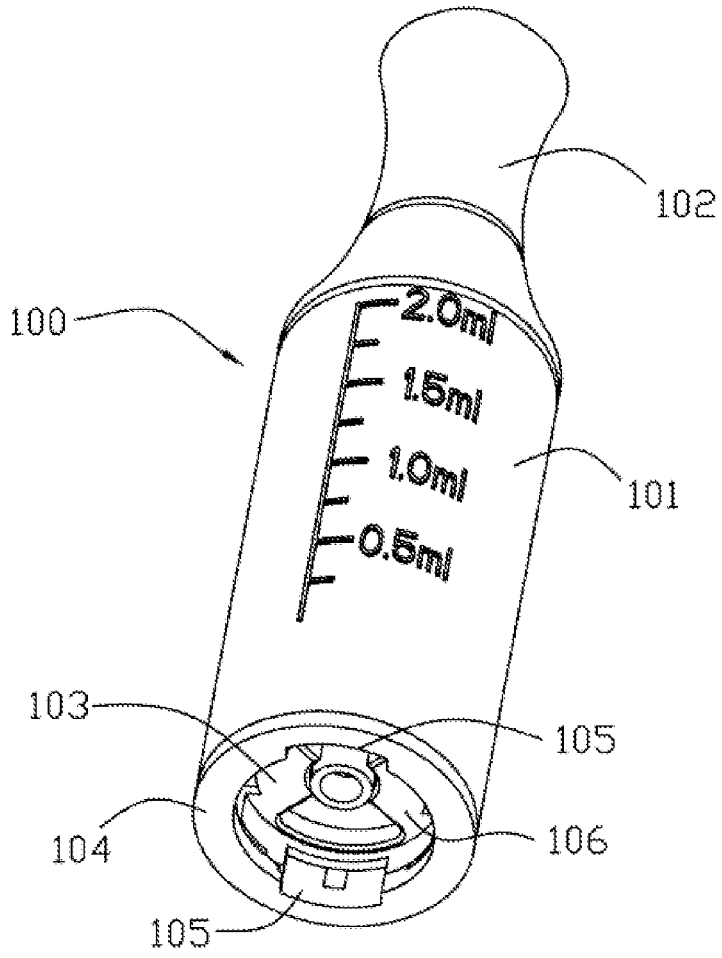
FIG. 1 is a perspective view of a liquid supply according to an embodiment.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Several definitions that apply throughout this disclosure will now be presented.

The term "outside" refers to a region that is beyond the outermost confines of a physical object. The term "inside" indicates that at least a portion of a region is partially contained within a boundary formed by the object. The term "substantially" is defined to be essentially conforming to the particular dimension, shape or other word that substantially modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
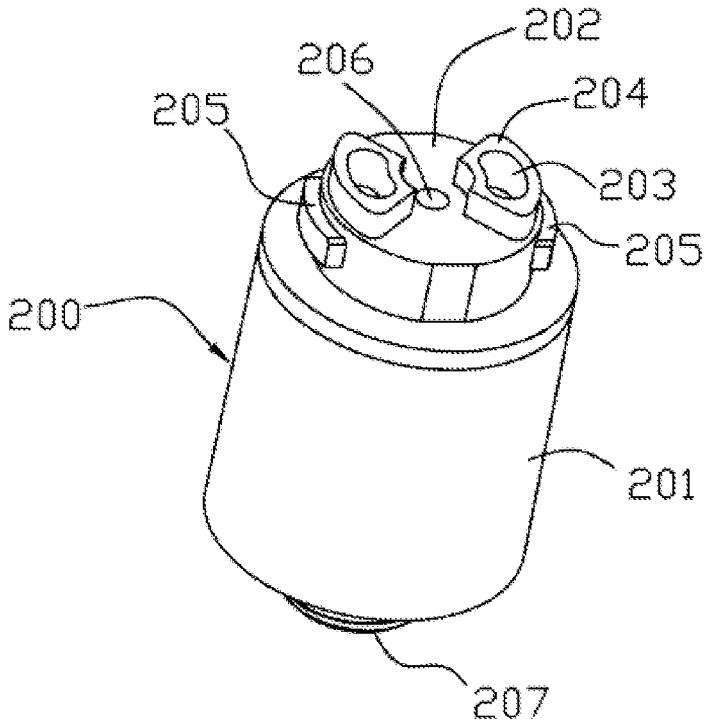
FIG. 2 is a perspective view of an atomizing assembly according to an embodiment.

Referring to FIGS. 1-2, an atomizer for an electronic cigarette is shown. The atomizer includes a liquid supply 100 and an atomizing assembly 200. The liquid supply 100 includes a housing 101, and a mouthpiece 102 at an end of the housing 101. The mouthpiece 102 and the housing 101 are integrally formed. The housing 101 defines a cavity for receiving tobacco liquid. In the present embodiment, the housing 101 is made of transparent material, and includes scales for showing quantity of the tobacco liquid remained in the liquid supply. The housing 101 includes an open end 103 at an end away from the mouthpiece 102. The atomizing assembly 200 is detachably connected to the open end 103. A rotation component 106 is provided in the open end 103. In a usual state, the rotation component 106 seals the tobacco liquid in the liquid supply 100. When the atomizing assembly 200 is connected to the open end 103, the atomizing assembly 200 drives the rotation component 106 to rotate, so that the tobacco liquid in the liquid supply 100 flows into the atomizing assembly 200.

The atomizing assembly 200 includes a shell 201. The shell 201 defines an atomizing cavity inside. The atomizing assembly 200 includes an atomizing unit in the atomizing cavity. The atomizing unit is configured (i.e., structured and arranged) for heating the tobacco liquid to form aerosol (described in detail later). The atomizing assembly 200 includes a connector 202 for connecting with the liquid supply 100. The connector 202 defines liquid inlets 203 communicating with the atomizing cavity. In the present embodiment, the connector 202 includes two liquid inlets 203, which are symmetrically arranged. When the connector 202 is inserted into the open end 103 of the liquid supply 100, and is rotated a predetermined angle to couple with the liquid supply 200 by snap-fit, the rotation component 106 is driven to rotate to a position where the tobacco liquid in the liquid supply 100 flows to the liquid inlets 203. A detailed structure of the snap-fit connection between the liquid supply 100 and the liquid supply 200 will be described later.

The atomizing assembly 200 includes a threaded part 207 at one end away from the connector 202. The atomizing assembly 200 is connected to an external power supply to form an electronic cigarette via the threaded part 207. When the tobacco liquid in the liquid supply 100 is used up, only a new liquid supply 100 is replaced, and the atomizing assembly 200 can be used repeatedly. Accordingly, the atomizer of the present embodiment is environmentally friendly.

Figure 3:
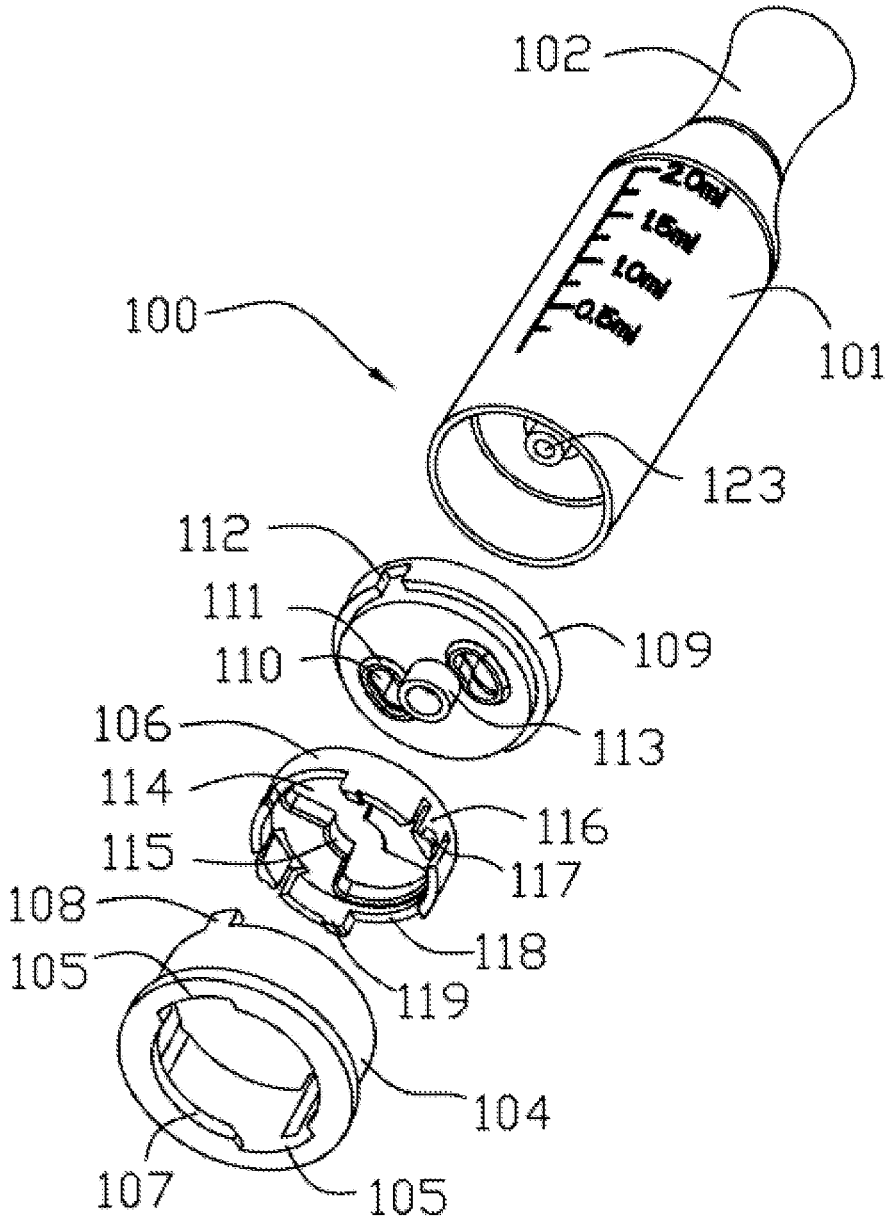
FIG. 3 is an exploded perspective view of the liquid supply of FIG. 1.

Referring to FIGS. 2-3, the liquid supply 100 further includes a connecting ring 104 at the open end 103. The connecting ring 104 is substantially circular. The rotation component 106 is rotatably received in the connecting ring 104. The connector 202 includes a protruding part 205 on a sidewall thereof. In the present embodiment, the connector 202 includes two protruding parts 205, which are symmetric relative to a central axis of the atomizing assembly 200. The connecting ring 104 defines a plurality of guiding slots 105 for insertion of the protruding part 205, and includes two step portions 107 extending inwards. The step portions 107 are configured for engaging with the protruding parts 205 to form a snap-fit connection. The guiding slots 105 are oriented along a circumferential direction of the liquid supply 100. In the present embodiment, the connecting ring 104 defines two guiding slots 105, which are spatially corresponding to the protruding parts 205. The step portions 107 are arranged on an inner surface of the connecting ring 104, and arc-shaped.

The liquid supply 100 is provided with a sealing component 109 in the open end 103. The sealing component 109 defines a liquid outlet 110. The sealing component 109 is configured for sealing the tobacco liquid in the liquid supply 100. In the present embodiment, the sealing component 109 defines two liquid outlets 110 corresponding to the liquid inlets 203. It is to be understood that the sealing component 109 may define one or more than two liquid outlets 110. A top surface of the rotation component 106 abuts against the sealing component 109, so that the liquid outlets 110 are sealed. When the rotation component 106 is rotated to a predetermined position, the liquid outlets 110 are open.

An assembly process of the liquid supply 100 will be described below. The rotation component 106 is first placed inside the connecting ring 104. The rotation component 106 defines gaps 118 in a sidewall thereof, and lengths of the gaps 118 are identical with that of the guiding slots 105. The rotation component 106 is assembled in such a manner that each of the gaps 118 is in alignment with a corresponding guiding slot 105, so that the protruding parts 205 pass through the guiding slots 105 and extend into the gaps 118. Then the sealing component 109 is placed to abut against the rotation component 106, and is fixedly mounted in the connecting ring 104. In detail, the connecting ring 104 includes positioning rods 108 formed on a sidewall thereof, and the sealing component 109 defines positioning slots 112 in a sidewall thereof. The positioning rods 108 match with the positioning rods 108. The sealing component 109 is coupled to the connecting ring 104 in such a manner that the positioning rods 108 are engaged in the positioning slots 112. Last, the connecting ring 104 is inserted into the open end 103 of the housing 101. In this way, the open end 103 is sealed by the sealing component 109. In the present embodiment, the connecting ring 104 is engaged in the open end 103 of the housing 101 by interference fit.

In a preferred embodiment, the connector 202 includes at least one protrusion 204. In the present embodiment, the connector 202 includes two protrusions 204. The liquid inlets 203 are defined in the two protrusions 204. The rotation component 106 defines receiving holes 114, which match with the protrusions 204 in shape. When the connector 202 is inserted into the open end 103 of the liquid supply 100, the protrusions 204 insert into the receiving holes 114 and abut against the sealing component 109. The protrusions 204 are capable of driving the rotation component to rotate. During rotation of the rotation component 106, the receiving holes 114 and the liquid inlets 203 of the protrusions 204 are still relative to each other. When the connector 202 is first placed into the open end 103 (in a first position, or an original position), the liquid outlets 110 and the liquid inlets 203 are misaligned, and the liquid outlets 110 are sealed by solid part of the rotation component 106. When the connector 202 drives the rotation component 106 to a second position, the liquid outlets 110 are aligned with the liquid inlets 203 in a one-to-one relationship.

Figure 4:
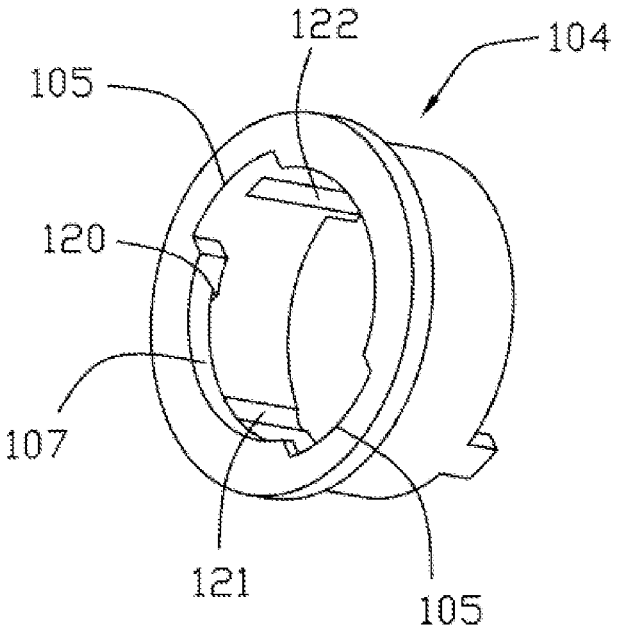
FIG. 4 is a perspective view of a liquid supply according to an embodiment.

Also referring to FIGS. 3-4, the rotation component 106 includes protruding positioning parts 117 on a side surface thereof. The positioning parts 117 are in the form of a protrusion or a protruding rod. The connecting ring 104 defines a first positioning groove 121 and a second positioning groove 122 in an inner surface thereof. During rotation, the positioning parts 117 are shifted between the first and the second positioning grooves 121, 122. Quite usefully, the positioning parts 117 are provided on an elastic arm 116. The elastic arm 116 and the rotation component 106 cooperatively define a slit, so that the elastic arm 116 deforms when the positioning parts 117 are disengaged from the first positioning groove 121 or the second positioning groove 122. In a preferred embodiment, the first positioning groove 121 and the second positioning groove 122 form an arc angle of 90 degrees on an inner surface of the connecting ring 104.

Referring to FIG. 4, the connecting ring 104 includes a first restricting part 120 slightly protruding from the step portion 107. The first restricting part 120 is slightly higher than the step portion 107 in an axial direction of the connecting ring 104. Correspondingly, the rotation component 106 also includes a second restricting part 119. When connector 202 is in a first position, the protruding parts 205 are engaged in the guiding slots 105, and the rotation component 106 is not yet rotated relative to the connecting ring 104. When the connector 202 drives the rotation component 106 to rotate 90 degrees, the first restricting part 120 abuts against the second restricting part 119, and the first restricting part 120 prevents the connector 202 from rotating excessively. In this position, the positioning part 117 is engaged in the positioning slot 121, and the connector 202 is in a second position, the liquid outlets 110 communicate with the liquid inlet 203. When the connector 202 is rotated along a reversed direction to the first position, the rotation component 106 is also rotated 90 degrees to block the liquid outlets 220.

Referring to FIG. 3, to improve sealing effect, the sealing component 109 includes two ring-shaped sealing gaskets 111 on a surface thereof, surrounding edges of the liquid outlets 110. In the present embodiment, the sealing gaskets 111 are made of silica gel, and are integrally formed with the sealing component 109. The sealing gaskets 111 protrude from the surface of the sealing component 109, which is in contact with the rotation component 106. When the rotation component 106 blocks the liquid outlet 110, the sealing gaskets 111 are in elastic contact with a surface of the rotation component 106. When the liquid outlets 110 align with the liquid inlets 203, the sealing gaskets 111 elastically abut against end surfaces of the protrusions 204. In this way, the seal gaskets 111 can prevent liquid leakage.

Air passage for flow of aerosol in the atomizing assembly 200 will be described below. The liquid supply 100 includes an air pipe 123 communicating with the mouthpiece 102. The air pipe 123 and the housing 101 are integrally formed. Aerosol formed in the atomizing cavity 209 passes through the air pipe 123, and is then sucked through the mouthpiece 102.

The connector 202 defines an air outlet 206 in a central part thereof. The air outlet 206 communicates with the atomizing cavity 209. The sealing component 109 includes a tube 113 extending along an axial direction thereof. The tube 113 and the sealing component 109 are integrally formed. The air outlet 206 communicates with the air pipe 123 via the tube 113. The rotation component 106 defines a through hole 115 in a central part thereof. The rotation component 106 is coupled to the sealing component 109 in such a manner that the tube 113 extend through the through hole 115. The through hole 115 communicates with the receiving holes 114. The two liquid outlets 110 of the sealing component 109 are symmetric about a central axis of the tube 113. The rotation component 106 is capable of rotating around the central axis of the tube 113 when driven by the connector 202.

Figure 5:
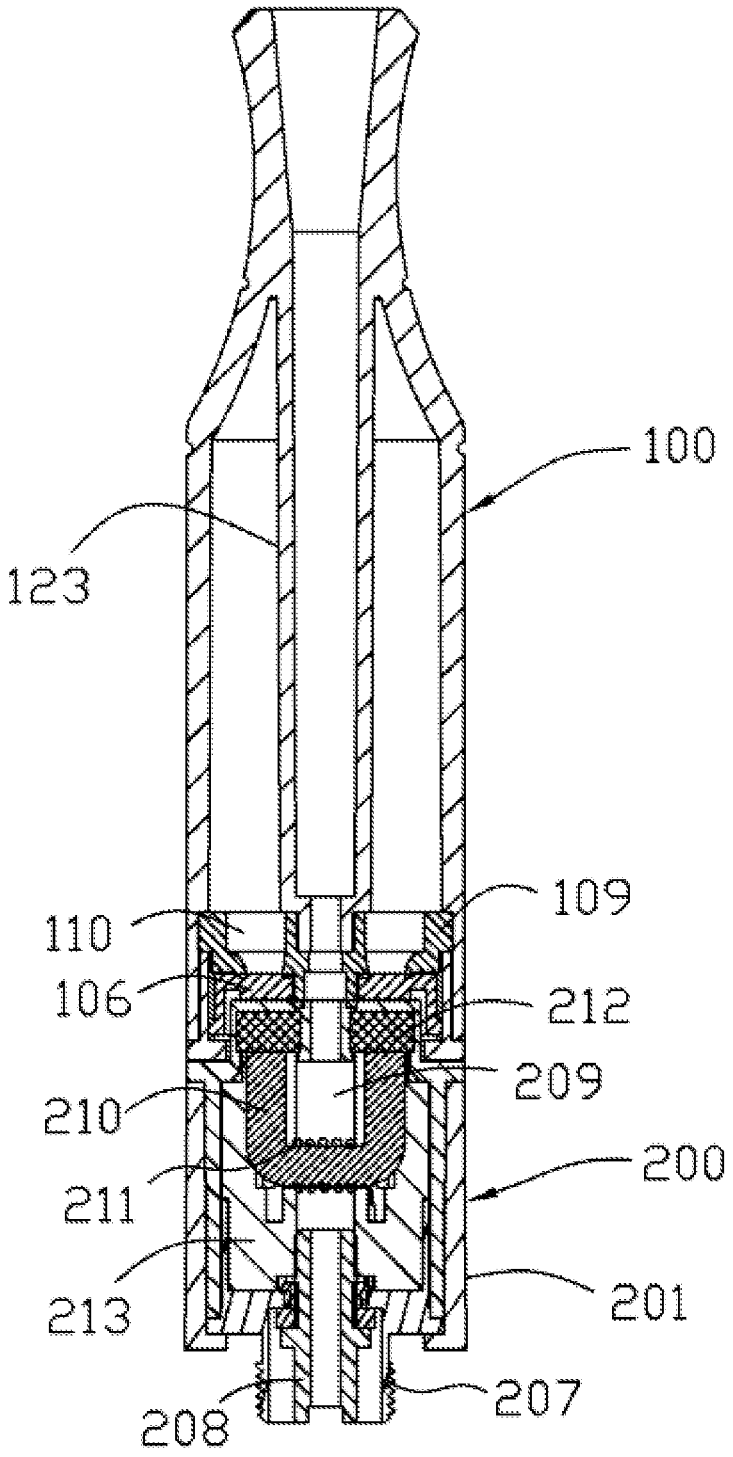
FIG. 5 is a cross-sectional view of an atomizer including the liquid supply and the atomizing assembly according to an embodiment.
Figure 6:
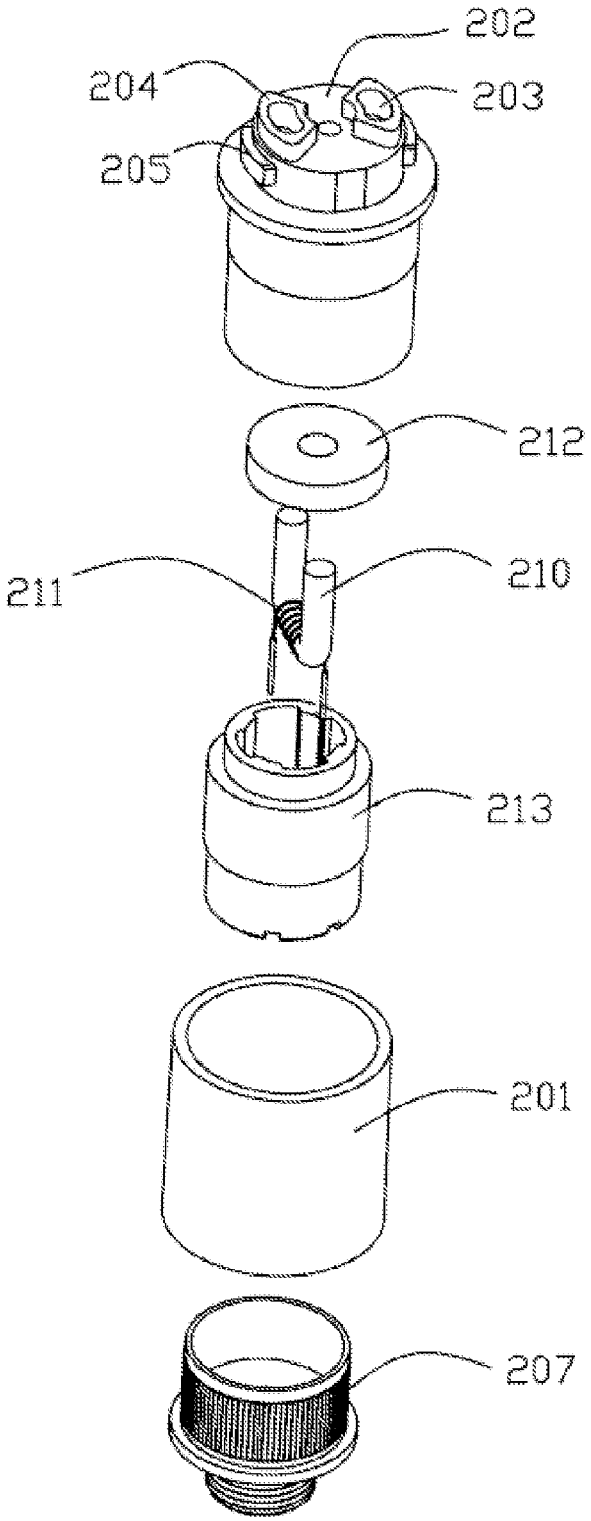
FIG. 6 is an exploded perspective view of the atomizing assembly of FIG. 2.

Referring to FIGS. 5-6, an internal structure of the atomizing assembly 200 will be described. The shell 201 defines the atomizing cavity 209 inside. The atomizing unit is arranged in the atomizing cavity 209. In the present embodiment, the atomizing unit includes a liquid conducting body 210 and a heating element 211 in contact with the liquid conducting body 210. The liquid conducting body 210 is porous. The heating element 211 is wound around a middle portion of the liquid conducting body 210. The liquid conducting body 210 is fixedly mounted in a holder 213. Two ends of the liquid conducting body 210 are respectively adjacent to the liquid inlets 203, and are configured for absorbing tobacco liquid from the liquid inlets 203. The connector 202 is arranged on an end of the shell 201. The heating element 211 aligns with the air outlet 206 of the connector 202, so that the aerosol formed by the heating element 211 can pass through the air outlet 206. An opposite end of the shell 201 is provided with a threaded sleeve 207 and a tubular electrode 208. The tubular electrode 208 is insulated from the threaded sleeve 207, and nested in the threaded sleeve 207. The tubular electrode 208 is a hollow structure, so that air can enter the atomizing cavity 209 from inside of the tubular electrode 208. The atomizing assembly 200 is threadedly coupled to an external power supply via the threaded sleeve 207. The tubular electrode 208 and the threaded sleeve 207 are electrically connected to positive and negative electrodes of the power supply. Two opposite ends of the heating element 211 are connected to the threaded sleeve 207 and the tubular electrode 208.

In a preferred embodiment, a liquid absorbing body 212, made of fibrous material, is provided between ends of the liquid conducting body 210 and the liquid inlets 203. Two ends of the liquid conducting body 210 abut against the liquid absorbing body 212. The liquid absorbing body 212 absorbs the tobacco liquid from the liquid inlets 203, and can hold the tobacco liquid temporarily. The tobacco liquid absorbed in the liquid absorbing body 212 is conveyed to the heating element 211 via the liquid conducting body 210. The liquid absorbing body 212 prevents too much tobacco liquid from flowing into the atomizing cavity 209. In an alternative embodiment, the liquid absorbing body 212 is omitted, two ends of the liquid conducting body 210 are inserted into the two liquid inlets 203 respectively, and are filled in the liquid inlets 203 fully.

Figure 7:
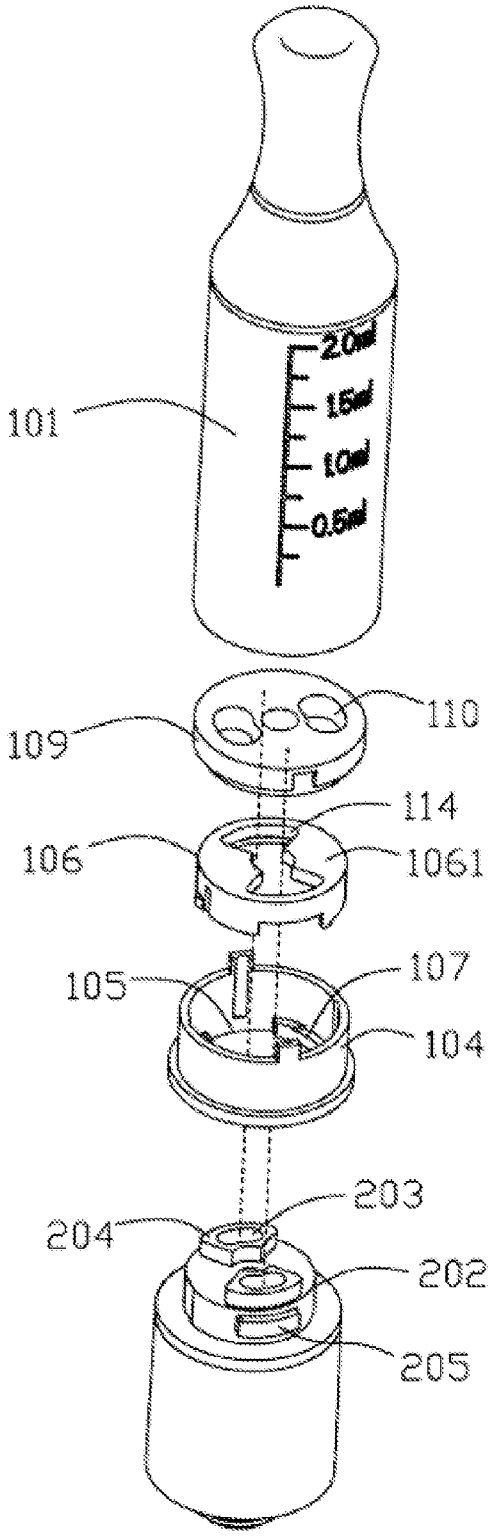
FIG. 7 is a perspective view of the atomizer in a first state where the rotation component blocks liquid outlets of a sealing component.
Figure 8:
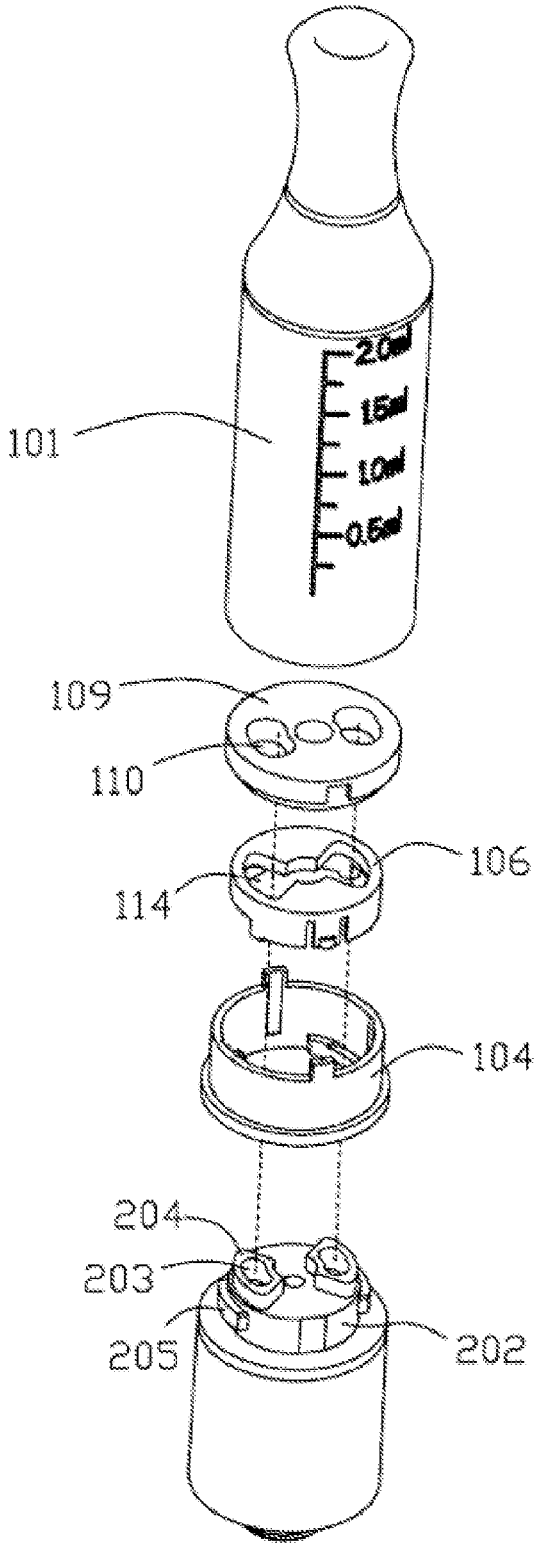
FIG. 8 is a perspective view of the atomizer in a second state where the liquid outlets are open.

Referring to FIGS. 7-8, during rotation, the housing 101, the sealing component 109, and the connecting ring 104 are kept still, only the rotation component 100 together with the connector 202 are rotated. As shown in FIG. 7, when the protruding parts 205 are inserted into the guiding slots 105, the protrusions 204 insert into receiving holes 114. In this original position, the receiving holes 114 are not in alignment with the liquid outlets 110, and a top surface 1061 of the rotation component 106 tightly abuts against the liquid outlets 110 to seal the tobacco liquid. As shown in FIG. 8, after the connector 202 is rotated 90 degrees, the protruding parts 205 are engaged with the step portions 107, the rotation component 106 is also rotated 90 degrees. In this position, the liquid outlets 110 align with the liquid inlets 203. When the connector 202 is rotated to the original position, the connector 202 and the rotation component 106 are in a state as shown in FIG. 7.

Figure 9:
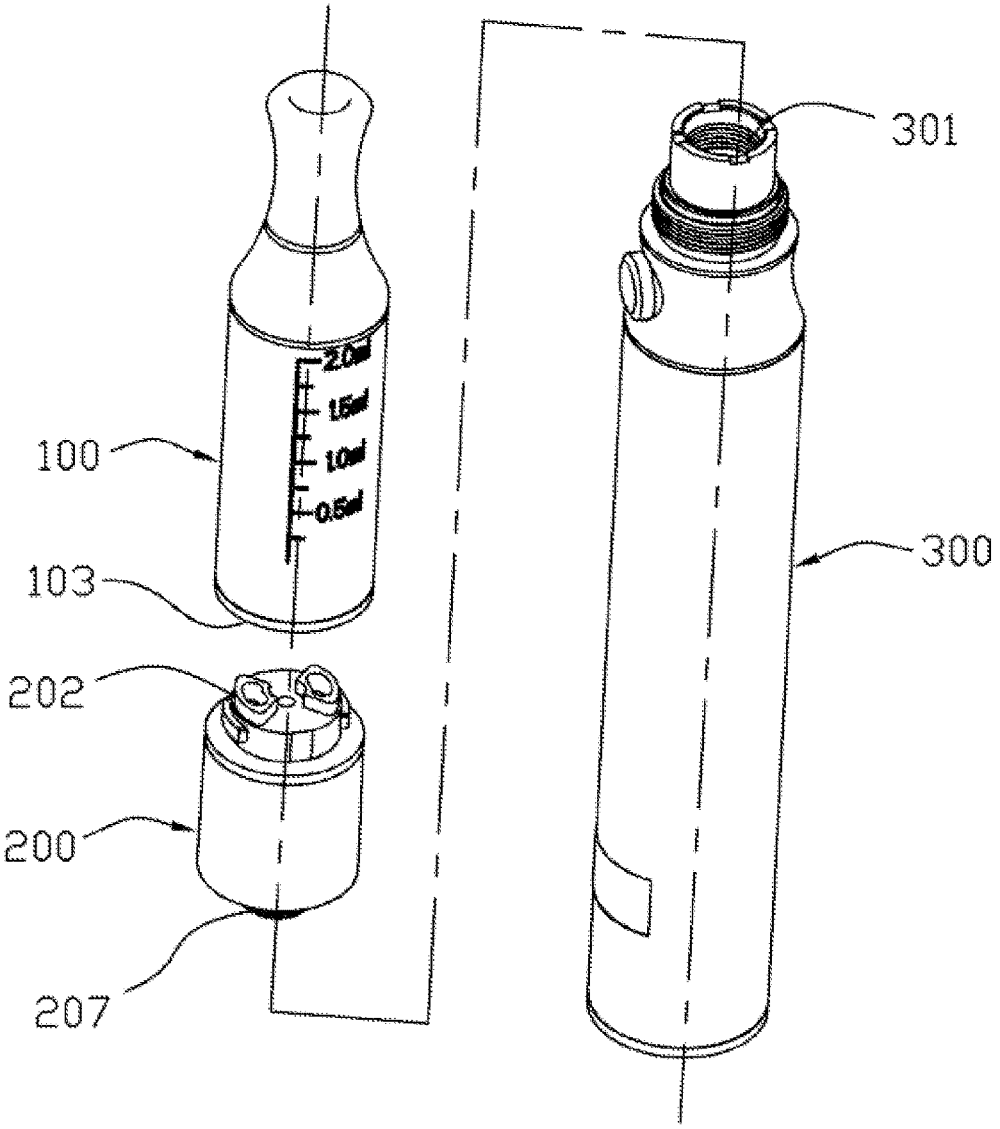
FIG. 9 is a perspective view of an electronic cigarette when unassembled according to another embodiment.

Referring to FIG. 9, an electronic cigarette is shown. The electronic cigarette includes the liquid supply 100, the atomizing assembly 200, and a power supply 300 sequentially connected. The atomizing assembly 200 includes a connector 202 at a first end, and a threaded sleeve 207 at an opposite second end. The first end of the atomizing assembly 200 is engaged with the open end 103 of the liquid supply 103 by snap-fit. The power supply includes a threaded part 301. The threaded part 301 is coupled to the threaded sleeve 207 by screw threads. The power supply 300 is configured for providing the atomizing assembly 300 power.

It is understood that the above-described embodiments are intended to illustrate rather than limit the disclosure. Variations may be made to the embodiments and methods without departing from the spirit of the disclosure. Accordingly, it is appropriate that the appended claims be construed broadly and in a manner consistent with the scope of the disclosure.

What is claimed is:

1. An atomizer, comprising:

a liquid supply configured for storing tobacco liquid, the liquid supply having an open end; and an atomizing assembly detachably connected to the open end, the atomizing assembly comprising an atomizing cavity and an atomizing unit, the atomizing unit being configured for heating the tobacco liquid to form aerosol;

wherein the atomizing assembly comprising a connector configured for connecting with the liquid supply, the connector defines a liquid inlet, the open end is provided with a sealing component having a liquid outlet, the connector is engaged in the open end to form a snap-fit connection after the connector is rotated a predetermined angle; the liquid supply further comprises a rotation component abutting against the sealing component, the connector is capable of driving the rotation component to rotate between a first position where the rotation component blocks the liquid outlet, and a second position where the liquid outlet communicates with the liquid inlet, when the connector is engaged in the open end, the rotation component is in the second position.

2. The atomizer of claim 1, wherein the connector comprises a protrusion on a surface thereof, the liquid inlet is defined in the protrusion, the rotation component defines a receiving hole, the receiving hole matches with the protrusion in shape, the protrusion is received hole, and abuts against the sealing component.

3. The atomizer of claim 1, wherein the liquid supply further comprises a connecting ring fixedly mounted in the open end, the rotation component is rotatably received in the connecting ring, the connector has a protruding part on a sidewall thereof; the connecting ring comprises two step portions extending inwards and a guiding slot for insertion of the protruding part, and the step portion is configured for engaging with the protruding part to form the snap-fit connection.

4. The atomizer of claim 3, wherein the rotation component comprises a protruding positioning part on a side surface thereof, and the connecting ring defines a first positioning groove and a second positioning groove in an inner surface thereof; when the rotation component is in the first position, the positioning part is coupled with the first positioning groove; when the rotation component is in the first position, the positioning part is engaged the first positioning groove.

5. The atomizer of claim 4, wherein the first positioning groove and the second positioning groove form an arc angle of 90 degrees on an inner surface of the connecting ring.

6. The atomizer of claim 1, wherein the sealing component comprises a ring-shaped sealing gasket on a surface abutting against the rotation component, and the sealing gasket surrounds an edge of the liquid outlet.

7. The atomizer of claim 1, wherein the liquid supply comprises a housing, a mouthpiece, and an air pipe, the mouthpiece is integrally formed with the housing, and the air pipe communicates with the mouthpiece, so that the aerosol formed in the atomizing cavity can reach the mouthpiece via the air pipe.

8. The atomizer of claim 7, wherein the connector defines an air outlet in a central part thereof, the air outlet communicates with the atomizing cavity, the sealing component comprises a tube extending along an axial direction thereof, and the air outlet communicates with the air pipe via the tube.

9. The atomizer of claim 8, wherein the rotation component defines a through hole in a central part thereof, and the rotation component is coupled to the sealing component in such a manner that the tube extend through the through hole.

10. The atomizer of claim 1, wherein the atomizing unit comprises a liquid conducting body and a heating element in contact with the liquid conducting body, ends of the liquid conducting body is configured for absorbing tobacco liquid flowed from the liquid inlet, and the heating element is configured for heating the tobacco liquid to form aerosol.

11. The atomizer of claim 10, wherein the liquid supply further comprises a liquid absorbing body sandwiched between ends of the liquid conducting body and the liquid inlet, and the liquid absorbing body is made of fibrous material.

12. An electronic cigarette, comprising:

an atomizer according to claim 1; and a power supply configured for providing the atomizer power.

13. The electronic cigarette of claim 12, wherein the connector comprises a protrusion on a surface thereof, the liquid inlet is defined in the protrusion, the rotation component defines a receiving hole, the receiving hole matches with the protrusion in shape, the protrusion is received hole, and abuts against the sealing component.

14. The electronic cigarette of claim 12, wherein the liquid supply further comprises a connecting ring fixedly mounted in the open end, the rotation component is rotatably received in the connecting ring, the connector has a protruding part on a sidewall thereof; the connecting ring comprises two step portions extending inwards and a guiding slot for insertion of the protruding part, and the step portion is configured for engaging with the protruding part to form the snap-fit connection.

15. The electronic cigarette of claim 14, wherein the rotation component comprises a protruding positioning part on a side surface thereof, and the connecting ring defines a first positioning groove and a second positioning groove in an inner surface thereof; when the rotation component is in the first position, the positioning part is coupled with the first positioning groove; when the rotation component is in the first position, the positioning part is engaged the first positioning groove.

16. The electronic cigarette of claim 15, wherein the first positioning groove and the second positioning groove form an arc angle of 90 degrees on an inner surface of the connecting ring.

* * * * *